US006419567B1

(12) United States Patent
Glashauser

(10) Patent No.: US 6,419,567 B1
(45) Date of Patent: Jul. 16, 2002

(54) RETAINING RING FOR CHEMICAL-MECHANICAL POLISHING (CMP) HEAD, POLISHING APPARATUS, SLURRY CYCLE SYSTEM, AND METHOD

(75) Inventor: Walter Glashauser, Oberhaching (DE)

(73) Assignee: Semiconductor 300 GmbH & Co. KG, Dresden (DE)

( * ) Notice: Subject to any disclaimer, the term of this patent is extended or adjusted under 35 U.S.C. 154(b) by 0 days.

(21) Appl. No.: 09/638,725

(22) Filed: Aug. 14, 2000

(51) Int. Cl.[7] ..... B24B 29/00

(52) U.S. Cl. ..... 451/259; 451/288; 451/290; 451/398; 451/446

(58) Field of Search ..... 451/285, 41, 259, 451/270, 288, 289, 290, 364, 397, 398, 402, 415, 442, 446

(56) References Cited

U.S. PATENT DOCUMENTS

| | | | | |
|---|---|---|---|---|
| 5,205,082 A | | 4/1993 | Shendon et al. | 51/283 R |
| 5,533,924 A | | 7/1996 | Stroupe et al. | 451/286 |
| 5,571,044 A | | 11/1996 | Bolandi et al. | 451/385 |
| 5,624,299 A | | 4/1997 | Shendon | 451/28 |
| 5,635,083 A | | 6/1997 | Breivogel et al. | 216/88 |
| 5,643,061 A | | 7/1997 | Jackson et al. | 451/289 |
| 5,664,988 A | | 9/1997 | Stroupe et al. | 451/41 |
| 5,664,990 A | | 9/1997 | Adams et al. | 451/60 |
| 5,695,392 A | * | 12/1997 | Kim | 451/288 |
| 5,700,180 A | | 12/1997 | Sandhu et al. | 451/5 |
| 5,707,492 A | | 1/1998 | Stager et al. | 156/645.1 |
| 5,755,614 A | | 5/1998 | Adams et al. | 451/60 |
| 5,762,539 A | | 6/1998 | Nakashiba et al. | 451/41 |
| 5,762,544 A | | 6/1998 | Zuniga et al. | 451/285 |
| 5,795,215 A | | 8/1998 | Guthrie et al. | 451/286 |
| 5,803,799 A | | 9/1998 | Volodarsky et al. | 451/288 |
| 5,857,899 A | | 1/1999 | Volodarsky et al. | 451/72 |
| 5,868,896 A | | 2/1999 | Robinson et al. | 156/344 |
| 5,879,226 A | | 3/1999 | Robinson | 451/287 |
| 5,882,243 A | | 3/1999 | Das et al. | 451/5 |
| 5,916,015 A | | 6/1999 | Natalicio | 451/288 |
| 5,948,204 A | | 9/1999 | Maveety et al. | 156/345 |
| 5,993,302 A | | 11/1999 | Chen et al. | 451/285 |
| 6,004,193 A | | 12/1999 | Nagahara et al. | 451/285 |
| 6,012,964 A | | 1/2000 | Arai et al. | 451/5 |
| 6,062,963 A | * | 5/2000 | Lin et al. | 451/398 |
| 6,089,961 A | * | 7/2000 | Cesna et al. | 451/287 |
| 6,110,012 A | * | 8/2000 | Maury et al. | 451/36 |
| 6,136,710 A | * | 10/2000 | Quek et al. | 438/691 |

FOREIGN PATENT DOCUMENTS

| | | | |
|---|---|---|---|
| EP | 0548846 | 6/1993 | B24B/37/04 |
| EP | 0589433 | 3/1994 | B24B/37/04 |
| EP | 0599299 | 6/1994 | B24B/37/04 |
| EP | 0786310 | 7/1997 | B24B/37/04 |
| WO | WO 99/58297 | 11/1999 | B24B/41/06 |

* cited by examiner

*Primary Examiner*—Timothy V. Eley
(74) *Attorney, Agent, or Firm*—Laurence A. Greenberg; Werner H. Stemer; Ralph E. Locher

(57) ABSTRACT

In a chemical-mechanical polishing machine (101) where a polishing head (100) holds a wafer (150) against a polishing pad (140), a retaining ring (300) that surrounds the wafer (150) has an open chamber (350) to distribute pressurized slurry (144) to the polishing pad (140) and to the periphery (153) of the wafer (150).

14 Claims, 4 Drawing Sheets

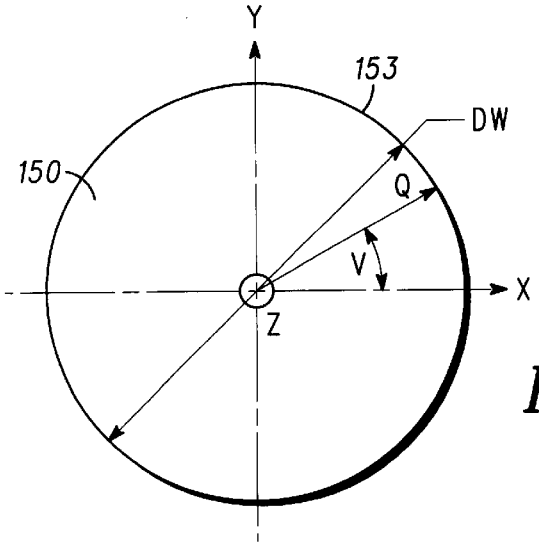
FIG. 2A
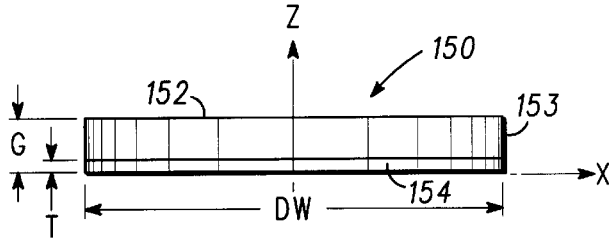
FIG. 2B
FIG. 3
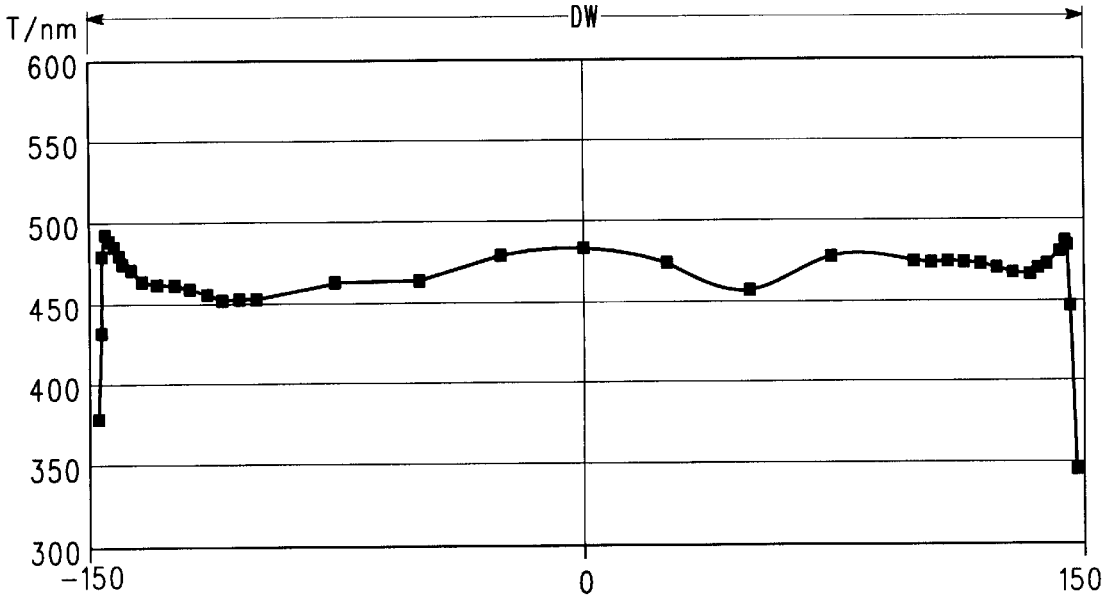

RETAINING RING FOR CHEMICAL-MECHANICAL POLISHING (CMP) HEAD, POLISHING APPARATUS, SLURRY CYCLE SYSTEM, AND METHOD

RELATED APPLICATION

The present application is related to U.S. application "Polishing head for wafer, and method for polishing" by Glashauser et al., having Ser. No. 09/527.859 filed Mar. 17, 2000.

FIELD OF THE INVENTION

The present invention generally relates to an apparatus and to a method for fabricating semiconductor wafers and, more particularly, to chemical-mechanical polishing (CMP).

BACKGROUND OF THE INVENTION

Chemical-mechanical polishing (CMP) removes material from the top layer of a wafer in the production of ultra-high density integrated circuits (instead of "polishing", "planarization" is also used). Often, the top layer is an oxide film (e.g., silicon dioxide), but other materials can also be removed. In a typical CMP process, the top layer of the wafer is exposed to an abrasive medium under controlled chemical, pressure, velocity, and temperature conditions. Conventional abrasive media include slurry solutions and polishing pads.

The slurry solutions generally contain small, abrasive particles (e.g., silicon dioxide for oxide polishing), and chemically-reactive substances (e.g., potassium hydroxide for oxide polishing).

The polishing pads are generally planar pads made from a relatively porous material such as blown polyurethane, and the polishing pads may also contain abrasive particles.

Thus, when the pad and/or the wafer moves with respect to each other, material is removed from the top layer mechanically by the abrasive particles in the pad and/or slurry, and chemically by the chemicals in the slurry.

In the competitive semiconductor industry, it is desirable to minimize the number of defective or impaired circuits on each wafer.

Therefore, CMP must consistently and accurately produce a uniform, planar surface of the top layer because it is, for example, important to accurately focus the image of circuit patterns in further fabrication steps. As the density of integrated circuits increases, it is often necessary to accurately focus the critical dimensions of the circuit pattern to better than a tolerance of approximately 0.01 micro meter ($\mu$m). Focusing the circuit patterns to such small tolerances, however, is very difficult when the distance between the lithography equipment and the surface of the wafer varies because the top layer surface is not uniformly planar.

For the application of CMP and for prior art designs, the following references are useful: U.S. Pat. No. 5,205,082 (Shendon et al.), U.S. Pat. No. 5,533,924 (Stroupe et al.), U.S. Pat. No. 5,571,044 (Bolandi et al.), U.S. Pat. No. 5,624,299 (Shendon), U.S. Pat. No. 5,635,083 (Breivogel et al.), U.S. Pat. No. 5,643,061 (Jackson et al.), U.S. Pat. No. 5,664,988 (Stroupe et al.), U.S. Pat. No. 5,664,990 (Adams et al.), U.S. Pat. No. 5,700,180 (Sandhu et al.), U.S. Pat. No. 5,707,492 (Stager et al.), U.S. Pat. No. 5,755,614 (Adams et al.), U.S. Pat. No. 5,762,539 (Nakashiba et al.), U.S. Pat. No. 5,762,544 (Zuniga et al.), U.S. Pat. No. 5,795,215 (Guthrie), U.S. Pat. No. 5,803,799 (Volodarsky et al.), U.S. Pat. No. 5,857,899 (Volodarsky et al.), U.S. Pat. No. 5,868,896 (Robinson et al.), U.S. Pat. No. 5,879,226 (Robinson) U.S. Pat. No. 5,882,243 (Das et al.), U.S. Pat. No. 5,948,204 (Maveety et al.), U.S. Pat. No. 5,993,302 (Chen et al.), U.S. Pat. No. 6,004,193 (Nagahara et al.), U.S. Pat. No. 6,012, 964 (Arai et al.); as well as European and PCT documents EP 0 548 846 B1 (Shendon et al.), EP 0 589 433 B1 (Hirose et al.), EP 0 599 299 B1 (Okumura et al.), EP 0 786 310 A1 (Volodarsky et al.) and WO 99/58297 (Perlov et al.).

BRIEF DESCRIPTION OF THE DRAWINGS

FIG. 2AB illustrates simplified top and side views of a wafer having a top layer to be polished;

FIG. 3 illustrates a simplified plot of top layer thickness versus coordinate X—after polishing;

DETAILED DESCRIPTION OF THE PREFERRED EMBODIMENT

Side views use Cartesian coordinate system XYZ. Unless specified otherwise, the X-axis goes right, the Y-axis goes into the page, and the Z-axis goes up (right-hand-rule). The terms "up" and "down" are convenient synonyms to indicate positive and negative direction senses along the Z-axis, respectively.

Where convenient, some views also use polar coordinate system QV with radius Q and angle V. For purposes of explanation, the origin of both system is defined as the center of the wafer at the top layer. A system transformation can be accomplished using well-known relations (e.g., Pythagora's theorem, sine or cosine functions).

The term "wafer" stands collectively for any planar work-piece having a top layer to be polished. Preferably, the work-piece is a semiconductor wafer. However, it is recognized that the polishing technique according to the present invention can be applied to a work-piece not limited to a semiconductor wafer, such as to a compact disk, a liquid crystal display etc.

Subscript indices are "W" for "wafer" and "R" for "ring". A glossary of symbols is provided at the end of the specification prior to the claims.

Figure 1A:
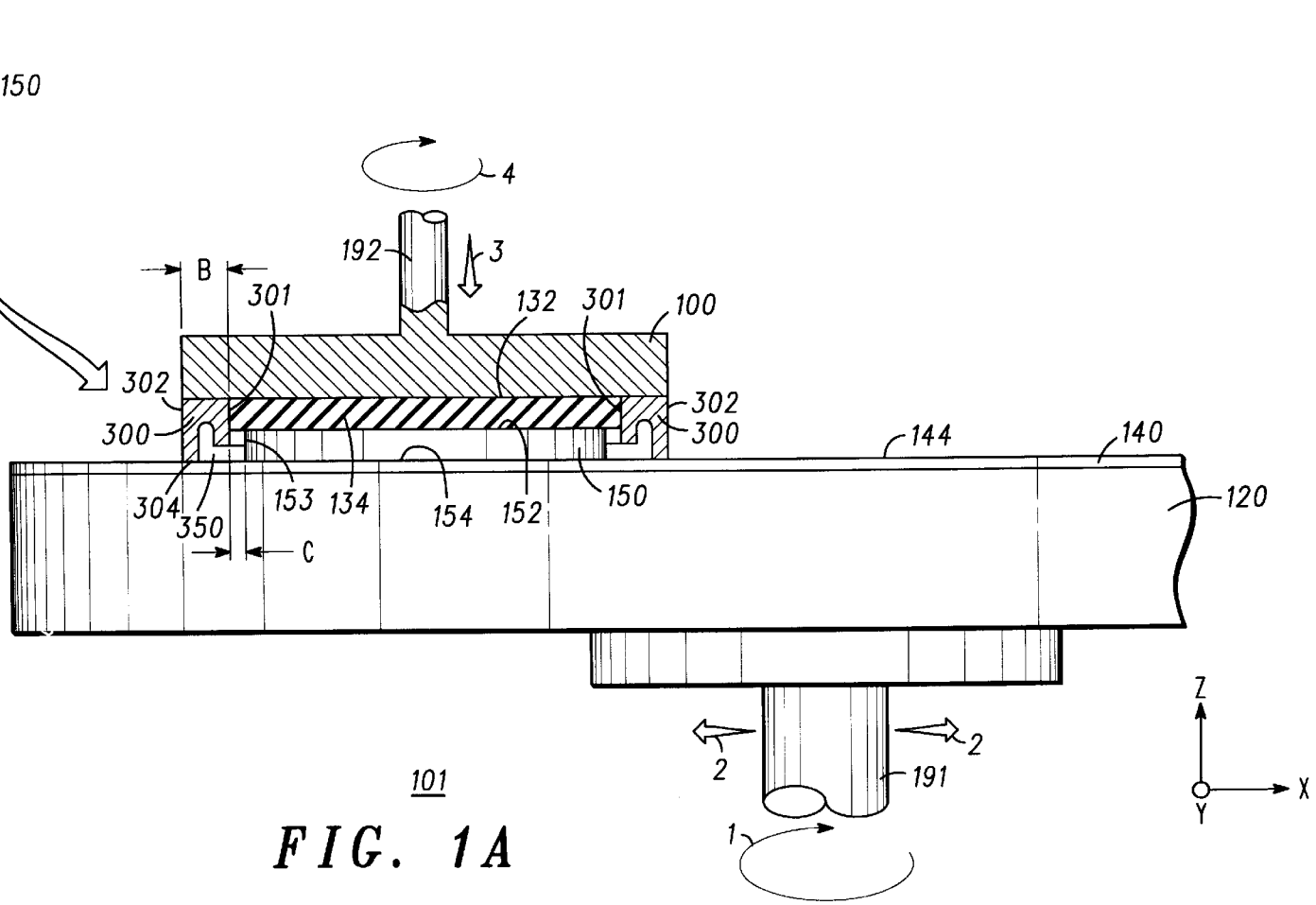
FIG. 1AB illustrates a simplified side view of a chemical-mechanical polishing (CMP) machine according to the present invention, the machine having a platen, a polishing head with a retaining ring and a resilient member, as well as a polishing pad with slurry.

FIG. 1AB illustrates a simplified diagram of CMP machine 101 according to the present invention comprising platen 120 (or "turn table"), polishing head 100 (or "wafer carrier", right-going hatching) with retaining ring 200/300 (left-going hatching), as well as polishing pad 140 with slurry 144.

In the following, reference numerals 300, 301 . . . etc. are used when referring to a retaining ring according to the present invention. Details are explained in connection with FIGS. 5–7. According to the present invention, ring 300 has an U-shape profile (preferably, asymmetric). Ring 300 has outer and inner walls (cf. FIG. 5 for details) that enclose partially open chamber 350 adapted to apply pressurized fluid (preferably slurry) to pad 140.

Figure 1B:
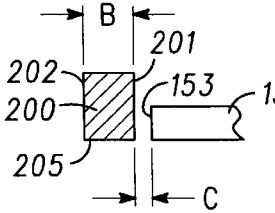
Figure 4:
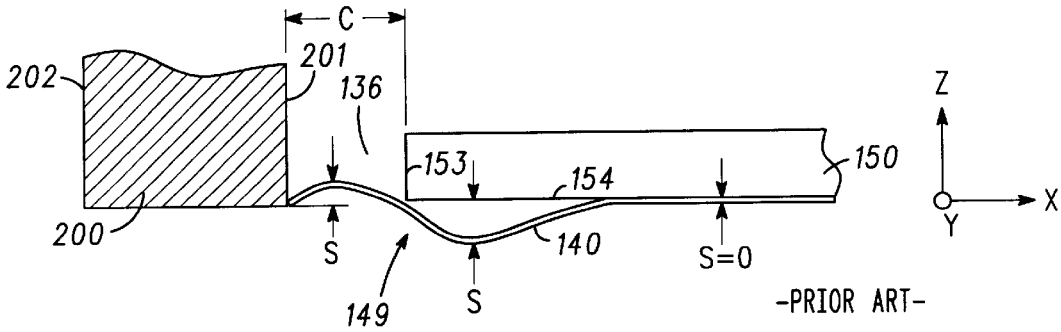
FIG. 4 illustrates—during polishing—an unwanted edge effect by a simplified and partial cross-sectional view of the wafer, the pad and a conventional retaining ring.

Reference numerals 200, 201 . . . etc. are used when referring to a conventional retaining ring (cf. FIG. 4). FIG. 1 illustrates ring 200 only by an auxiliary view (on the left side, FIG. 1B) that would replace the illustration of ring 300 (FIG. 1A).

Usually, drive assembly 191 rotates platen 120 as indicated by arrow 1, or reciprocates platen 120 back and forth as indicated by arrow 2.

Head 100 may be a weighted, free-floating carrier, or actuator assembly 192 may be attached to wafer carrier 100 to impart axial and rotational motion, as indicated by arrows 3 (Z-axis) and 4, respectively.

Wafer 150 is attached to resilient member 134 (e.g., a backing film) positioned between wafer 150 and lower surface 132 of head 100. Means to hold wafer 150 at head 100, especially during changing wafers, for example, means that temporarily apply vacuum to the wafer, are well known in the art and therefore not shown for simplicity. Member 134 prevents that head 100 directly touches backside 152 of wafer 150.

By surrounding wafer 150, retaining ring 200/300 keeps wafer 150 below head 100. Ring 200/300 has overall width B defined as the distance between inner annular surface 201/301 and outer annular surface 202/302.

Ring 200 touches pad 140 by lower surface 205. According to one aspect of the invention, details below, ring 300 touches pad 140 by a lower surface 304 (cf. FIG. 5) that is, comparison to surface 205, (a) smaller and (b) located more distant from wafer 150.

In the operation of CMP machine 101, wafer 150 is positioned face-downward with top layer 154 against polishing pad 140. As wafer 150 moves, polishing pad 140 and slurry 144 remove material from layer 154.

Since the inner diameter in surface 201/301 of ring 200/300 is slightly larger (e.g., by 0.2 . . . 20 milli meter (mm) or even less) than the wafer diameter (e.g., 300 mm), gap 136 ("clearance" C) between ring 200/300 and wafer periphery 153 occurs. An unwanted edge effect related to gap 136 is further discussed below.

Ring 300 is pressed to pad 140 by an adjustable down-force; the pressure applied by ring 300 to pad 140 is thereby distributed substantially equally across. An estimation about the value of the down-force is given in connection with the explanation of FIG. 5. Persons of skill in the art can adjust the down-force without the need of further explanation herein.

FIG. 2AB illustrates, in relation to both coordinate systems, simplified top (2A) and side (2B) views of wafer 150. Wafer 150 is shown with periphery 153 in both views and top layer 154 (to be polished) and backside 152 in the side view only. Wafer 150 has a diameter $D_W$ (e.g., 300 mm). T stands for the thickness of top layer 154; and G stands for the thickness of wafer 150 (between the surface of top layer 154 and backside 152). T is a function of Q and V. Measuring T (alongside Z-axis) is well known in the art. Variations of G are not relevant here.

FIG. 3 illustrates a simplified plot of top layer thickness T (in nano meter (nm)) versus coordinate X (in mm) obtained for a $D_W$=300 mm wafer after polishing with conventional retaining ring 200 (cf. auxiliary view in FIG. 1). In the example of FIG. 3, angle V is zero; similar results can be obtained for other V and for averaging V over the whole circle. The sharp increase in layer thickness T towards the wafer periphery is unwanted.

FIG. 4 illustrates—during polishing—the unwanted edge effect ("edge exclusion") by a simplified and partial view of wafer 150 (periphery 153, layer 154), pad 140, and conventional retaining ring 200 (surfaces 201, 202). FIG. 4 is intended to be an example, the edge effect can express itself otherwise too. As illustrated, the edge effect causes ripples 149 on pad 140; in other words, the pad surface locally shifts by displacement S in respect to the XY plane. For example, as indicated in FIG. 4, within gap 136, pad 140 moves upwards (positive S); below wafer 150 at the wafer periphery zone (e.g., the outermost 5 to 10 mm), pad 140 moves downwards (negative S); and near the center zone, pad 140 uniformly presses to top layer 154 (zero S).

The edge effect can be caused, for example, (i) by forces (in the XY plane) resulting from the relative movement between head 100 and platen 120 (cf. FIG. 1) and (ii) by the different pressures that ring 200 and wafer 150 apply to pad 140 (Z direction).

With the non-uniform displacement S, the pressure between pad 140 and layer 154 is also non-uniform. Hence, the material abrasion becomes non-uniform too; material is better removed from the periphery zone than from center zone (cf. FIG. 3; or vice versa). The edge effect might make the wafer periphery zone unsuitable for integrated circuits.

Quantities of the edge effect (e.g., displacement S, pressure, abrasion rate, periphery zone, etc.) depend, for example, on the hardness of pad 140, the clearance C of gap 136, and the relative speed between wafer 150 and pad 140.

Figure 5:
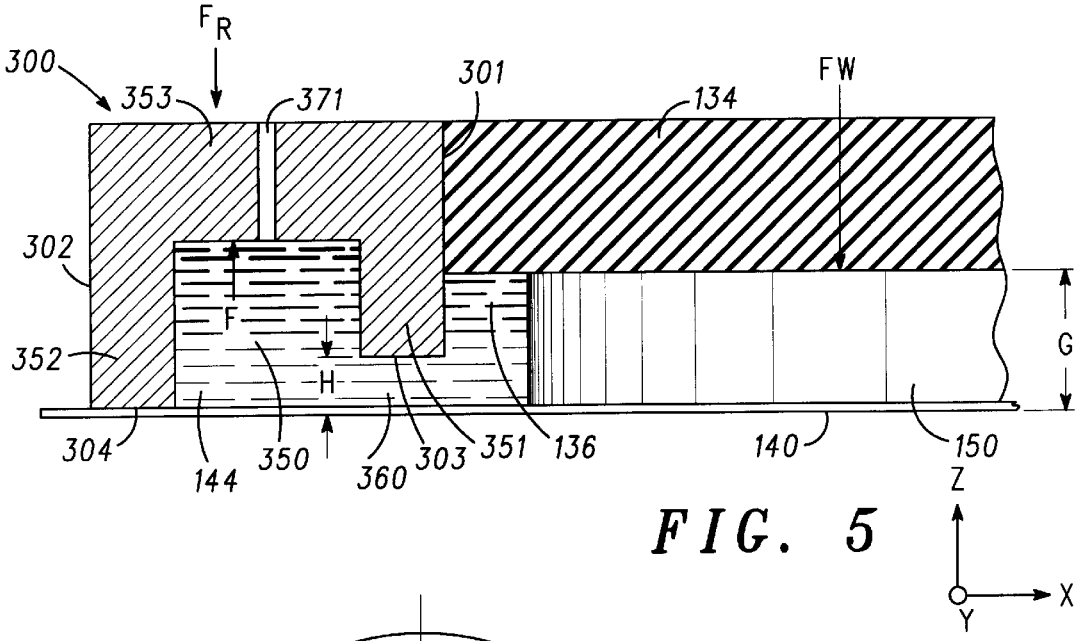
FIG. 5 illustrates—during polishing—an improvement by a simplified and partial cross-sectional view of the wafer, the pad, the resilient member and a retaining ring according to the present invention.

FIG. 5 illustrates—during polishing—an improvement by a simplified and partial cross-sectional view of wafer 150, pad 140, resilient member 134 and retaining ring 300 according to the present invention. The XZ plane is the section plane.

Similar as in the prior art, ring 300 has outer annular surface 302 and, arranged orthogonal thereto, lower surface 304. Surface 304 is ring-shaped and substantially flat. Surface 304 touches pad 140. In contrast to the prior art, ring 300 has inner annular surface 301 that, preferably, does not extend to pad 140. Lower surface 303 (substantially orthogonal to 301) is located above pad 140 at channel height H and does not touch pad 140. Channel 360 is formed between surface 303 and pad 140.

While lower surfaces 304 and 303 do not touch to each other, ring 300 has chamber 350 ("groove") for carrying a pressurized fluid. Preferably, this fluid is slurry 144, but fluid that is substantially not being abrasive can also be used.

Figure 6:
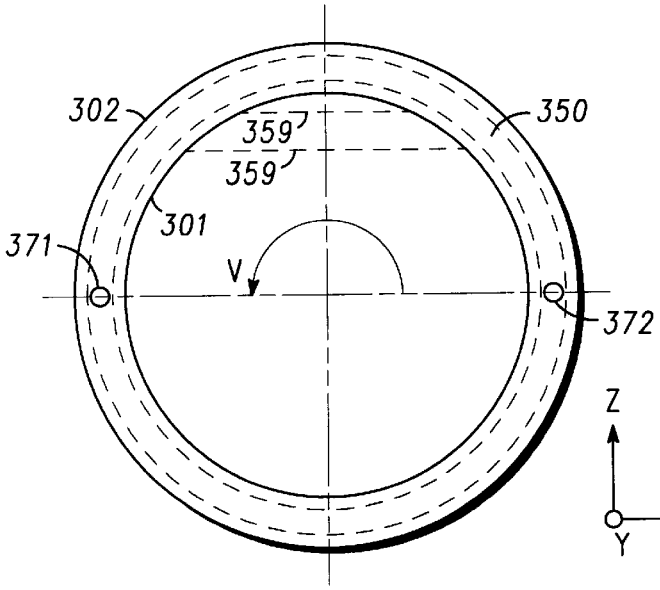
FIG. 6 illustrates a simplified top view of the retaining ring according to the present invention.

Conveniently, FIG. 5 also illustrates slurry inlet 371 for supplying slurry into chamber 350. A slurry outlet (similar to inlet 371) is illustrated in FIG. 6. Pressuring slurry can be accomplished by a person of skill in the art. For example, the pressure in chamber 350 is regulated by a pump at supply line 371 (cf. FIG. 7) and by a valve. Providing inlet 371 and outlet 372 at surface 302 (substantially in parallel to pad 140) is also possible.

Viewing the cross-section, ring 300 appears as an asymmetric U-shaped profile having base 353, outer wall 352 and inner wall 351 (short wall). Walls 351 and 352 are partly limited by surfaces 301 and 302, respectively. The shape of chamber 350 is not important; its illustration to be rectangular is provided only for convenience.

By having slurry 144 pressed within chamber 350, slurry 144 propagates through channel 360 into gap 136. Resilient member 134 prevents further propagation of slurry 144. Thereby, the pressure in chamber 350 is substantially equally distributed also to gap 136. Forces that would cause pad bending (cf. FIG. 4) are reduced. The pressure across the wafer is made more uniform by minimizing ripples (cf. FIG. 4) on polishing pad 140.

In other words, in comparison to the prior art (cf. ring 200), (i) the pad touching lower surface (cf. surface 205 in FIG. 1 vs. surface 304 in FIG. 5) is located more distant from the wafer; and (ii) gap 136 is pressurized with fluid (i.e. slurry).

Thereby, head 100 using ring 300 according to the present invention alleviates the edge effect. Using ring 300 leads to better uniformity of material removal throughout radius coordinate Q because local pressure from wafer 150 to pad 140 becomes substantially independent from radius coordinate Q.

Preferably, ring 300 is made of plastic or ceramic. Convenient values for B are in the range between 10 and 15 mm. Height H is preferably, larger than wafer thickness G (cf. FIG. 2, from top layer to backside). Preferably, H and G are related by a H-to-G ratio in the range between 1.05 to 2.0. Other values can also be used.

As mentioned above, an estimation for the adjustable down-force $F_R$ (ring 300 to pad 140) is given. $F_R$ is one of other forces: up-force F applied by slurry 144 counteracts on $F_R$; down-force $F_W$ applied through resilient member 134 acts from wafer 150 on pad 140. Considering the surface areas through that each force acts (e.g., surface 304, inside area of chamber 350, wafer surface); pressures $P_R$, P and $P_W$, respectively, can be defined. the pressures are conveniently considered by absolute values (symbol ||||). Preferably, the ring pressure $P_R$ is larger than or equal to the sum of the slurry pressure P and the wafer pressure $P_W$, that is $$|P_R| \geqq |P| + |P_W|.$$

Further, it is convenient when wafer 150 is changed to suck back slurry 144 or to keep slurry 144 in chamber 350 by below atmospheric pressure.

FIG. 6 illustrates a simplified top view of retaining ring 300. Corresponding to sectional view of FIG. 5, ring 300 is illustrated with inner annular surface 301, outer annular surface 302, and chamber 350 (dashed, because hidden). As illustrated for a preferred embodiment, slurry inlet 371 and slurry outlet 372 arranged in a angle V=180°. However, multiple inlets and multiple outlets can also be provided, conveniently, alternating in the order in/out/in/out, and spaced with V being the fraction of 360° over the total number of inlets/outlets.

Having used the terms "annular" and "ring" is convenient for explanation; however, it is not required that the geometry of ring 300 always has to keep equal distance to the center. As indicated by dashed lines 359, ring portion can optionally be sized and shaped to mate with the particular orientation edge discontinuity shape of a wafer.

Figure 7:
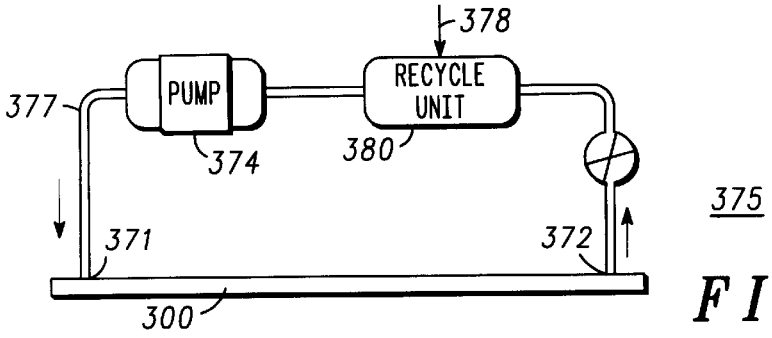
FIG. 7 illustrates a simplified block diagram of a slurry cycle system using the retaining ring according to the present invention.

FIG. 7 illustrates a simplified block diagram of slurry cycle system 375 using retaining ring 300 according to the present invention. Slurry cycle system 375 comprises slurry pump 374 and slurry recycle unit 380 that are coupled to slurry inlet 371 and slurry outlet 372 (cf. FIG. 6) by pipe arrangement 377 as illustrated. A preferred slurry flow direction is indicated by arrows. System 375 allows to reduce the consumption of slurry.

In other words, system 375 for cycling slurry from inlet 371 to outlet 372 has slurry distribution channel 350 that is part of retaining ring 300 of polishing head 100.

Recycle unit 380 recycles the slurry by techniques well known in the art such as filtering, blending (e.g., with fresh slurry 378, rejuvenating chemicals, or water), monitoring (e.g., temperature, pH, conductivity), heating or cooling, etc.

Monitoring can optionally be extended to endpointing the polishing process, for example, by measuring ion concentration in the slurry.

Having the invention implemented as illustrated and described in connection with the exemplary embodiment of FIGS. 1–7 is convenient, but not necessary. The following presents alternative embodiments.

Figure 8:
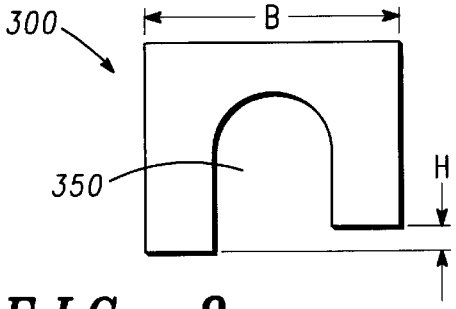
FIG. 8 illustrates a partial cross-sectional view of the retaining ring having a chamber with an alternative shape.

FIG. 8 illustrates a partial cross-sectional view of retaining ring 300 having chamber 350 with an alternative shape (half-circle).

Figure 9:
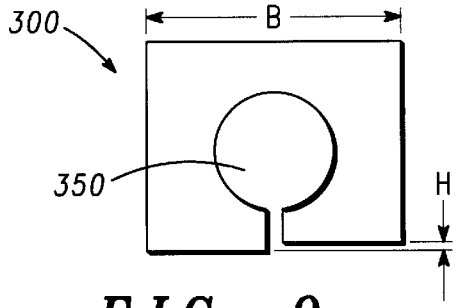
FIG. 9 illustrates a partial cross-sectional view of the retaining ring having a chamber with a further alternative shape.

FIG. 9 illustrates a partial cross-sectional view of retaining ring 300 having chamber 350 with a further alternative shape (full-circle).

Figure 10:
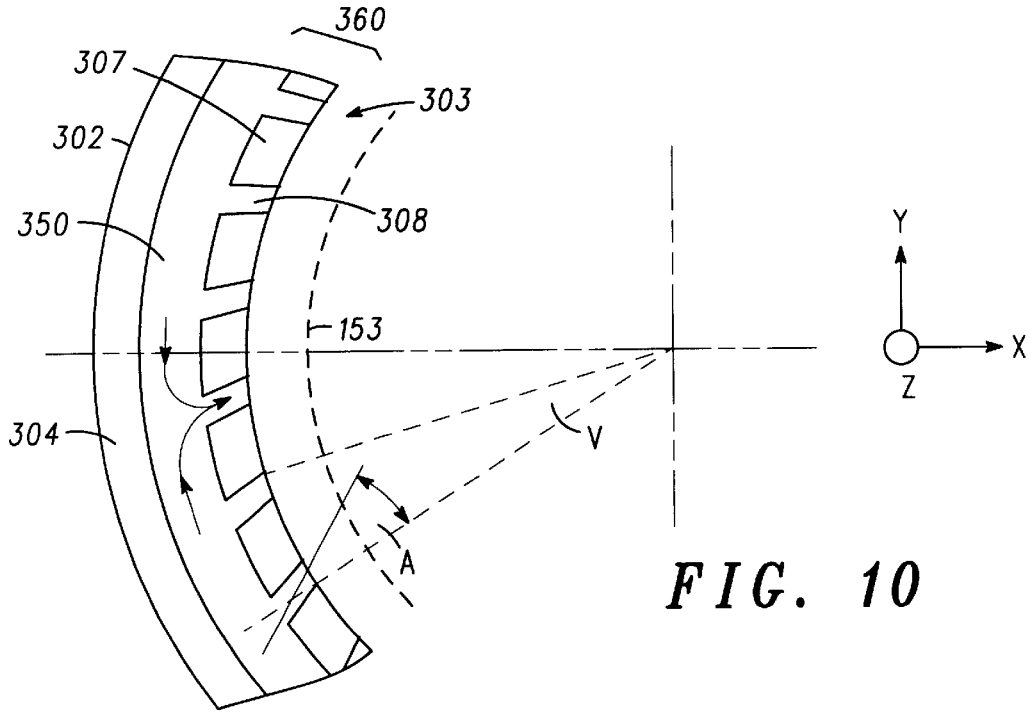
FIG. 10 illustrates a view from below of the retaining ring with an alternative lower surface.

FIG. 10 illustrates a view from below of retaining ring 300 with an alternative lower surface 303. For convenience, ring 300 is shown magnified in a circle segment. Surface 303 has a plurality of ring portions 307 that, preferably, touch pad 140 (i.e., H around zero). Between the portions, a plurality of slurry delivery channels 308. As indicated by arrows, channels 308 carry slurry from chamber 350 to wafer periphery 153 (shown dashed). The number N of channels 308 is between 150 and 500, a preferred value is N=200. The resulting intra-channel angle is calculates as 360°/N. Preferably, channels 308 are (a) arranged radially towards the center of ring 300, i.e. along the dashed lines towards the coordinate origin; or (b) as in FIG. 10 with angle A.

In other words, ring 300 of the embodiment of FIG. 5 has chamber 350 that applies slurry 144 (to pad 140) through channel 360 that is provided by a plurality of ring portions 307 for touching pad 140 and forming a plurality of slurry delivery channels 308.

Having described the invention is detail above, the invention is summarized as follows: Retaining ring 300 for encircling wafer 150 in chemical-mechanical polishing apparatus 101 is characterized by a U-shaped cross-section. Ring 300 has outer wall 352 and inner wall 351 that enclose partially open chamber 350 adapted to apply pressurized fluid 144 to polishing pad 140 of apparatus 101.

In other words, retaining ring 300 (for carrier head 100 that polishes wafer 150) comprises generally annular body 351, 352, 353 with substantially U-shaped cross-section, inner surface 301, outer surface 302 and groove 350 between the surfaces to distribute pressurized slurry along wafer periphery 153.

A chemical-mechanical polishing apparatus 101 with polishing pad 140 and polishing head 100 (to receive wafer 150 and to hold wafer 150 against pad 140) has retaining ring 300 to engage with head 100 and to surround wafer 150. Ring 300 has open chamber 350 to distribute pressurized slurry 144 to pad 140 and to periphery 153 of wafer 150.

A polishing head comprises a wafer supporting surface and a retaining ring engaged with the supporting surface to retain the wafer in place. The retaining ring is shaped such to carry slurry and has an inner surface facing the wafer but spaced to the pad to distribute slurry into a clearance between the wafer and the inner surface.

A method for operating chemical polishing apparatus 100 comprises the following steps: placing wafer 150 on pad 140, thereby surrounding wafer 150 by retaining ring 300; and applying slurry 144 through a chamber within retaining ring 300 to pad 140 and to space 136 between inner diameter surface 301 of ring 300 and periphery 153 of wafer 150.

While the invention has been described in terms of particular structures, those of skill in the art will understand based on the description herein that it is not limited merely to such examples and that the full scope of the invention is properly determined by the claims.

Symbols

A angle
B width
C clearance distance
D diameter
F force
H height
G wafer thickness
N number of delivery channels
P pressure
Q polar radius coordinate
R index for "ring"
S pad displacement
T layer thickness
V polar angle coordinate
W index for "wafer"
X Cartesian coordinate
Y Cartesian coordinate
Z Cartesian coordinate
mm milli meter
$\mu$m micro meter
nm nano meter
° degree
|| || absolute value

What is claimed is:

1. A retaining ring for encircling a wafer in a chemical-mechanical polishing apparatus, said retaining ring characterized by a U-shaped cross-section, said retaining ring having an outer wall and an inner wall, wherein said walls enclose a partially open chamber adapted to apply pressurized fluid to a polishing pad of said apparatus.

2. The retaining ring of claim 1 wherein said U-shaped cross-section is asymmetric.

3. The retaining ring of claim 1 wherein said fluid is pressurized slurry.

4. The retaining ring of claim 3, wherein when said retaining ring is used in said apparatus, said outer wall touches said polishing pad and said inner wall allows said pressurized slurry to propagate.

5. The retaining ring of claim 3, wherein when said retaining ring is used in said apparatus, said chamber applies said slurry through a channel that is limited between a lower surface of said inner wall and said polishing pad.

6. The retaining ring of claim 5, wherein the wafer has a thickness, wherein said channel has a height defined as a distance between said lower surface and said polishing pad, and wherein said height is larger than the thickness of said wafer.

7. The retaining ring of claim 3, wherein when said retaining ring is used in said apparatus, said chamber applies said slurry through a channel that is provided by a plurality of ring portions touching said polishing pad and forming a plurality of slurry delivery channels.

8. A retaining ring for a carrier head to polish a wafer, said retaining ring comprising a generally annular body having a substantially U-shaped cross-section, an inner surface, an outer surface and a groove between said surfaces to distribute pressurized slurry along the periphery of the wafer.

9. A chemical-mechanical polishing apparatus, comprising:

a polishing pad;

a polishing head to receive a wafer having a periphery and an overall thickness and to hold the wafer against the polishing pad; and a retaining ring to engage with said head and to surround the wafer, said retaining ring having:

an open chamber to distribute a pressurized slurry to said pad and to the periphery of the wafer;

an outer wall substantially touching said pad; and an inner wall being substantially spaced from said pad and being spaced from said pad by a channel having a height larger than the overall thickness of the wafer.

10. A chemical-mechanical polishing apparatus, comprising:

a polishing pad;

a polishing head to receive a wafer having a periphery and to hold the wafer against the polishing pad;

a retaining ring to engage with said head and to surround the wafer, said retaining ring having:

an outlet;

an inlet;

an open chamber to distribute a pressurized slurry to said pad and to the periphery of the wafer;

an outer wall substantially touching said pad; and an inner wall being substantially spaced from said pad; and a slurry recycle unit fluidically connected to said ring to cycle slurry from said outlet of said ring to said inlet of said ring.

11. The apparatus of claim 10 that endpoints the polishing process by monitoring slurry.

12. A chemical-mechanical polishing apparatus, comprising:

a polishing pad;

a polishing head to receive a wafer having a periphery and an overall thickness and to hold the wafer against the polishing pad; and a retaining ring to engage with said head and to surround the wafer, said retaining ring having:

an open chamber to distribute a pressurized slurry to said pad and to the periphery of the wafer;

an outer wall substantially touching said pad; and an inner wall being substantially spaced from said pad and being spaced from said pad by a channel having a height smaller than the overall thickness of the wafer.

13. A polishing head for polishing a semiconductor wafer by moving said wafer across a pad, said polishing head comprising:

a wafer supporting surface; and a retaining ring engaged with the supporting surface to retain the wafer in place, said retaining ring being shaped to carry slurry and having an inner surface facing the wafer but being spaced to said pad to distribute slurry into a clearance between said wafer and said inner surface.

14. A slurry cycle system for a CMP machine having a polishing head, said system for cycling slurry from an inlet to an outlet, said system characterized in that said inlet and said outlet are connected to a slurry distribution channel that is part of a retaining ring of said polishing head.

* * * * *